United States Patent [19]

Miller

[11] 3,963,389

[45] June 15, 1976

[54] MULTI-PIECE APEX SEAL FOR A ROTARY ENGINE

[75] Inventor: George E. Miller, Libertyville, Ill.

[73] Assignee: Outboard Marine Corporation, Waukegan, Ill.

[22] Filed: Apr. 10, 1975

[21] Appl. No.: 566,956

[52] U.S. Cl. ..... 418/121; 418/122

[51] Int. Cl.[2] ..... F01C 19/02

[58] Field of Search ..... 418/121, 122, 123, 124

[56] References Cited

UNITED STATES PATENTS

| | | | |
|---|---|---|---|
| 3,113,526 | 12/1963 | Paschke | 418/122 |
| 3,127,095 | 3/1964 | Froede | 418/121 |
| 3,400,691 | 9/1968 | Jones | 418/121 |
| 3,556,695 | 1/1971 | Yamamoto | 418/121 |

FOREIGN PATENTS OR APPLICATIONS

| | | | |
|---|---|---|---|
| 1,242,938 | 6/1967 | Germany | 418/122 |

*Primary Examiner*—C. J. Husar

*Attorney, Agent, or Firm*—Victor D. Behn; Arthur Frederick

[57] ABSTRACT

A multi-piece apex seal for a rotary engine in which the seal includes a main seal piece and corner seal piece at one or both ends of the main seal piece and in which at least one of the adjacent engaging surfaces of the main seal piece and a corner seal piece is arcuate to insure a flat fit between the corner seal piece and the adjacent housing end wall.

6 Claims, 6 Drawing Figures

PRIOR ART
FIG. 3
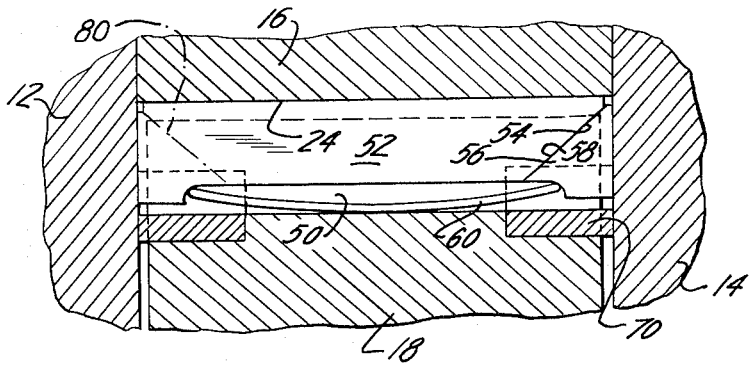
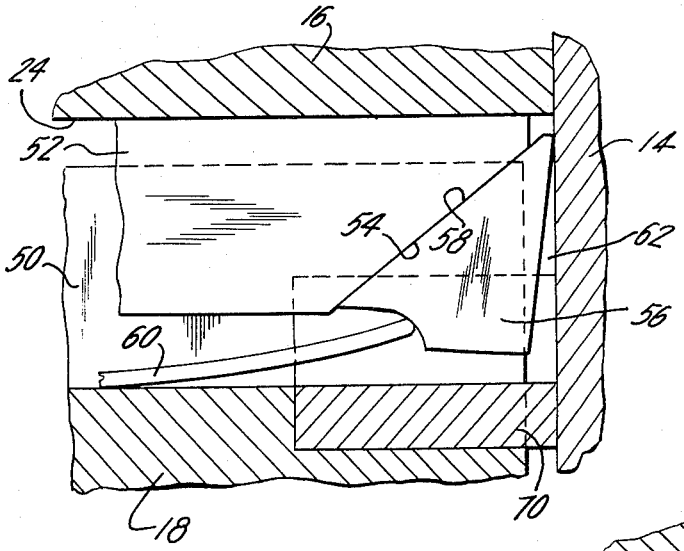
FIG. 4
PRIOR ART
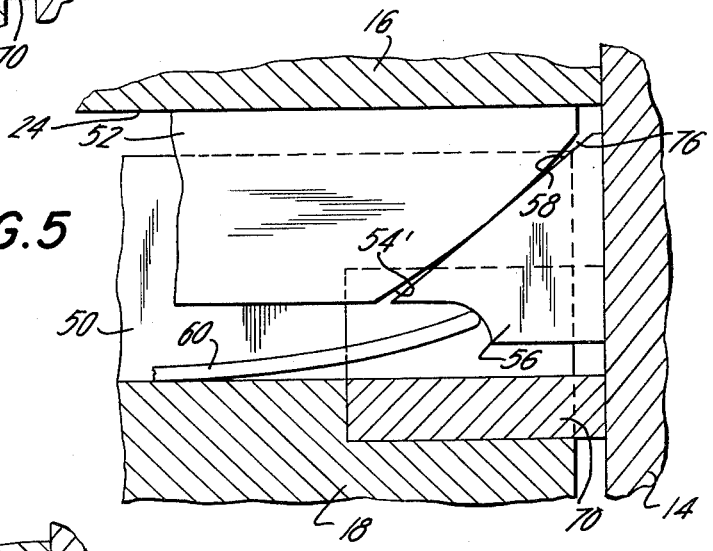
FIG. 5
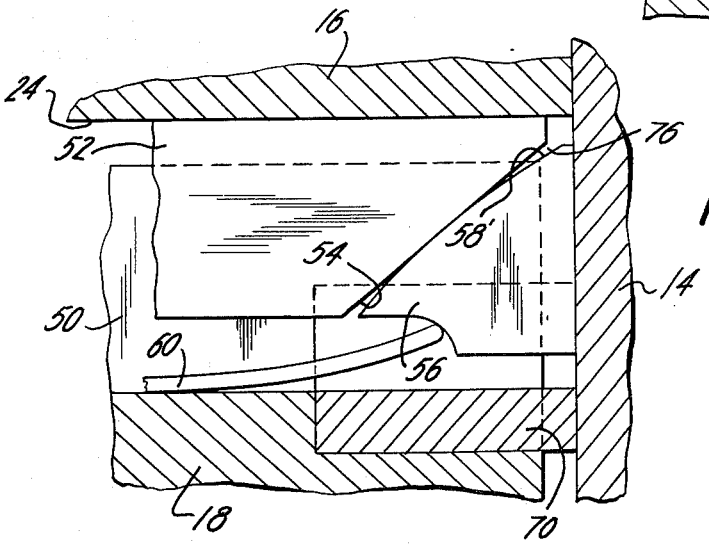
FIG. 6

MULTI-PIECE APEX SEAL FOR A ROTARY ENGINE

BACKGROUND OF THE INVENTION

The invention relates to the apex seals of rotary mechanisms such as rotary engines, rotary pumps or expansion engines and is particularly directed to an apex seal construction for such a mechanism, for example of the type disclosed in U.S. Pat. No. 3,400,691 or No. 3,712,767.

As disclosed in said prior patents, each apex seal consists of a main seal strip which extends substantially across the width of the engine cavity between its end walls with one or both ends of this main seal strip being cut back to form an inclined end face such that the outer edge of the strip is longer than its inner or bottom edge. A generally triangular shaped seal piece is placed at the inclined end or corner of the main seal piece to complete this corner of the apex seal. As shown in said prior patents, the main seal piece and the triangular end seal piece each have an inclined flat surface engaging an adjacent flat surface of the outer seal piece. These inclined flat engaging surfaces must be at precisely the proper angle otherwise the triangular end seal piece will be misaligned relative to and not run flat against the end wall of the adjacent side housing. In such a situation a corner of the end seal piece will run against the side housing. This may cause scuffing or grooving of the side housing and, in addition, because of said misalignment, the triangular end seal piece does not provide a good seal against the side housing thereby adversely affecting the efficiency of the rotary mechanism. It has been found that with the apex seal construction of this prior patent such misalignment of an end seal piece may result from normal manufacturing tolerances.

SUMMARY OF THE INVENTION

An object of the invention is to provide an improved multipiece apex seal configuration for rotary mechanisms of the type shown in the aforementioned prior patents such that each end seal piece always has a flat fit with the adjacent side housing regardless of manufacturing tolerances.

A still further object of the invention resides in the provision of such a multi-piece apex seal configuration in which at least one of the engaging surfaces of the main seal piece and an end seal piece is arcuate so that the end seal piece can lie flat against the adjacent side housing independently of any inaccuracies such as resulting from manufacturing tolerances.

More particularly it is an object of the invention to make at least one of the engaging surfaces of the main seal piece and an end seal piece convex to permit slight rocking adjustment of the corner seal piece so that it lies flat against the adjacent side housing.

Other objects and advantages of the invention will become apparent upon reading the following description in connection with the drawings.

BRIEF DESCRIPTION OF DRAWINGS

FIG. 3 is an enlarged view of an apex seal portion of FIG. 1.

FIG. 4 is a further enlarged view of a portion of FIG. 3 showing the result of an improper fit between the pieces of an apex seal.

FIG. 5 is a view similar to FIG. 4 but illustrating the invention.

FIG. 6 is a view similar to FIG. 5 but illustrating a modified form of the invention.

DESCRIPTION OF PREFERRED EMBODIMENTS

Figure 1:
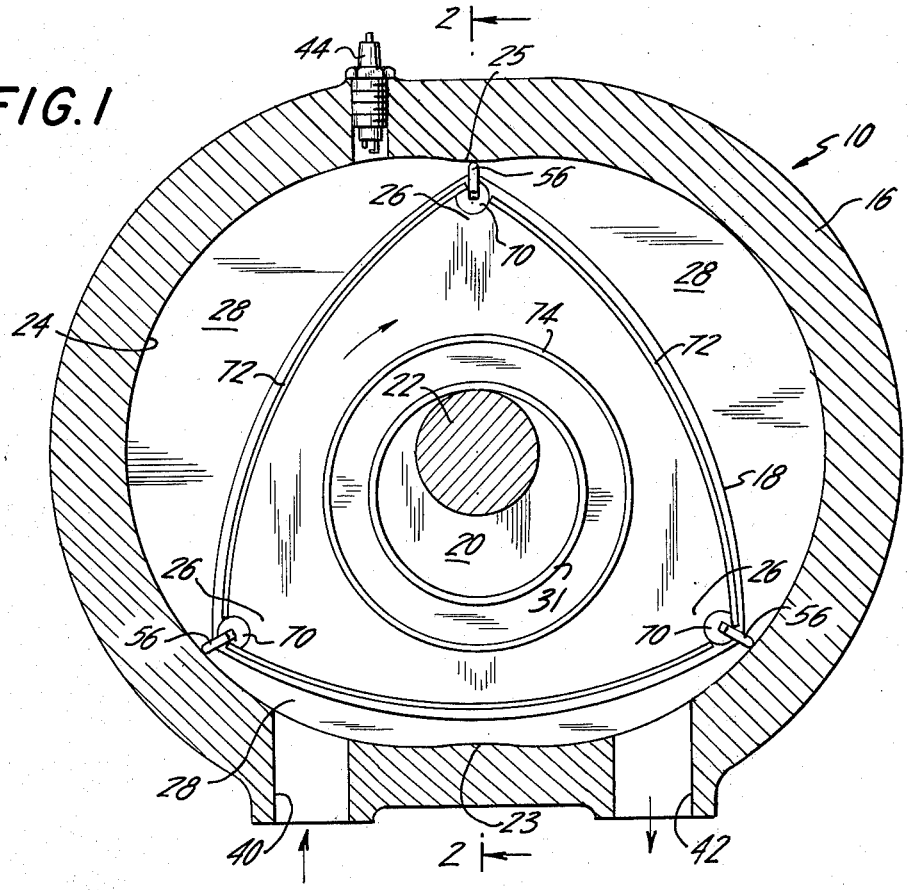
FIG. 1 is a transverse sectional view of a conventional rotary combustion engine and taken along line 1—1 of FIG. 2.
Figure 2:
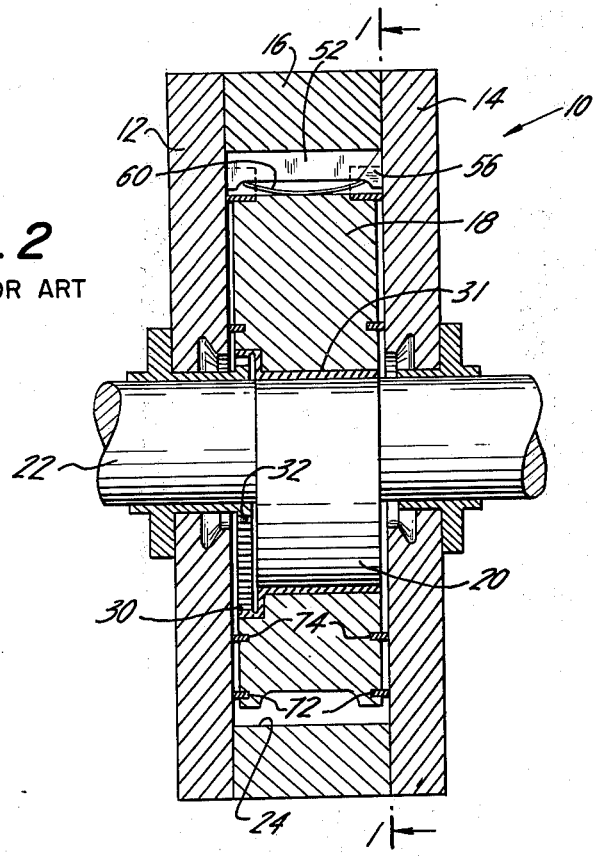
FIG. 2 PRIOR ART
FIG. 2 is a sectional view taken along line 2—2 of FIG. 1.

Referring first to FIGS. 1, 2 and 3 of the drawings, a rotary combustion engine is schematically indicated at 10, the engine and its apex seals being similar to that shown in aforementioned U.S. Pat. No. 3,400,691. The engine 10 comprises an outer body or housing consisting of two axially spaced end housings 12 and 14 and an intermediate or rotor housing 16, the housing being secured together to form an engine cavity therebetween. An inner body or rotor 18 is journaled for rotation within said housing cavity on an eccentric portion 20 of a shaft 22 which extends coaxially through and is supported by the end housings 12 and 14. The axis of the shaft 22 is perpendicular to the inner walls of the end housings 12 and 14.

The peripheral inner surface 24 of the intermediate housing 16 is illustrated as having a two-lobed profile which preferably is basically an epitrochoid, said two lobes joining at the junctions 23 and 25. The rotor 18 has a generally triangular profile with apex portions 26 having sealing cooperation with the trochoid surface 24 to form three engine working chambers 28 between the rotor 18 and the housings 12, 14 and 16.

The engine also includes an internal gear 30 formed on the rotor bearing hub 31 which is secured to the rotor and a fixed external gear 32 secured to the adjacent end housing 12. This gearing 30, 32 controls the rotation of the rotor relative to the shaft and housing.

The engine rotor housing 16 has a passage 40 for the engine intake charge, said passage being disposed adjacent to and on one side of the junction 23 of the two lobes of the epitrochoidal surface and said housing also has an exhaust passage 42 on the opposite side of said junction. A spark plug 44 is mounted on the rotor housing adjacent to the other junction 25 of said two lobes for initiating combustion.

In order to seal the working chambers 28 each rotor apex portion 25 has a groove 50 extending thereacross parallel to the engine axis for receiving a main apex seal strip 52. The outer edge of the seal strip extends substantially from the end housing 12 to the end housing 14. One end of the seal strip 52 has a face 54 inclined to the inner and outer edges of the seal strip 52 such that the inner edge of the seal strip is shorter than the outer edge. A generally triangular small seal piece 56 is also received in the rotor groove 50 at the one end of said groove adjacent to the inclined face 54 such that the seal piece 56 has an inclined face 58 for sealing engagement with the inclined face 54 of the main apex seal strip 52. A leaf spring 60 is disposed in the apex seal groove 50 under the apex seal 52, 56. The center of the spring bears against the bottom of the groove 50 and one end of the spring presses radially outwardly against one end of the main seal piece 52 and the other end presses radially outwardly against the small seal piece 56. In this way the spring 60 urges the apex seal 52, 56 radially outwardly against the trochoid surface 24 of the rotor housing 16. In addition, because of the engaged inclined surfaces 54 and 52, the two seal pieces 52 and 56 are urged axially against the adjacent end walls 12 and 14.

The seal grid for rotary engines such as the engine 10 generally also include cylindrical seal pins 70 located at each end of an apex seal groove 50 and having a slot aligned with the apex seal groove 50 so as to receive the adjacent ends of the apex seal. Spring means, not shown, is generally provided for urging each cylindrical seal pin 70 against the inner wall of the adjacent housing 12 or 14. In addition, seal strips 72 are generally provided on each end face of the rotor for engagement with the inner wall of the adjacent side housing 12 and 14, said seal strips 72 extending between adjacent seal pins 70. Each rotor end face may also be provided with a circular seal ring 74 coaxial with the rotor for sealing engagement with the inner wall of the adjacent side housing 12 or 14. The structure of the engine 10 so far described is conventional.

If one or both inclined surfaces 54 and 58 are not properly inclined, then, as shown in FIG. 4, the triangular apex seal piece 56 will be skewed as shown and therefore will not seat flat against the end wall 14. This improper fit can result from normal manufacturing tolerances involved in the fabrication of the apex seal pieces 52 and 56. As a result of this improper fit a substantial leakage gap 62 may be created between the apex seal piece 56 and the end wall 14 thereby causing excessive leakage between engine working chambers 28 during engine operaton. What is even more important, because of this improper fit, the corner of the triangular seal piece 56 engaging the inner wall of the side housing 14 may cause excessive wear, scuffing or even grooving of this wall. Obviously, an improper fit between the main seal piece 52 and end or triangular seal piece 56 may cause the inner corner of the triangular seal piece instead of the outer corner as illustrated in FIG. 4, to engage the inner wall of the side housing 14.

In accordance with the invention at least one of the inclined faces 54 and 58 of the apex seal pieces 52 and 56 is made arcuate as shown in FIG. 5. As there illustrated, the inclined face on the main seal piece 52 is made convex, this face being identified by reference numeral 54'. The other parts of FIG. 5 are identical to those of FIG. 4 and have been designated by the same reference numerals. Because the surface 54' is arcuate, the end seal piece 56 can now rock or tilt slightly to achieve a flat fit with the inner wall of the side housing 14 as a result of the force of the spring 60. Accordingly, with the invention of FIG. 5, the end seal piece 56 runs flat against the inner wall of the side housing 14 regardless of manufacturing tolerances involved in the fabrication of the seal parts 52 and 56. As a result, the aforementioned excessive wear, scuffing or even grooving of the side housing as a result of contact with only a corner of the seal piece 56 as in FIG. 4, has been eliminated with the invention of FIG. 5.

FIG. 5 also eliminates the leakage gap 62 existing in the prior art of FIG. 4. However, because the surface 54' is convex a slight leakage gap 76 now results between it and the surface 58 on the end seal piece 56. This leakage gap 76, however, is quite small for two reasons. Firstly, because the curvature (exaggerated in the drawing) of the surface 54' to compensate for manufacturing tolerances in fabrication of the seal pieces 52 and 56 can be quite small. Secondly, since the two seal pieces 52 and 56 will be pressed against one side or the other of their rotor groove 50 by the pressure differential between adjacent working chambers 28, only the portion of the gap 76 which is radially outwardly beyond the rotor 18 constitutes a leakage path.

Instead of making only the inclined surface 54' arcuately convex as illustrated in FIG. 5 both inclined surfaces 54 and 58 may be made arcuate or only the surface 58 may be made arcuate. This latter modification is shown in FIG. 6. Thus, in FIG. 6 the inclined surface on the end seal piece 56 is now made convex and identified by the reference numeral 58' while the inclined surface on the main seal piece 52, identified by reference numeral 54, is now flat. FIG. 6 is otherwise like FIG. 5 and similar parts have been designated by similar reference numerals.

Because surface 58' of the end seal piece 56 in FIG. 6 is convex, this seal piece will, under the force of the spring 60, rock about the adjacent surface of the main seal piece so as to be flat against the inner wall of the side housing 14. Accordingly, the apex seal 52,56 of FIG. 6 functions exactly the same as in FIG. 5 and therefore no further description of FIG. 6 is necessary.

As disclosed in aforementioned U.S. Pat. No. 3,400,691, triangular end seal pieces 56 may, if desired, be provided at both ends of the main seal piece 52. Such a second end seal piece has been illustrated by the dot and dash line 80 in FIG. 3. In accordance with the invention the arcuate fit between the main seal piece and a corner seal piece shown in FIGS. 5 or 6 is provided between the main seal pieces 52 and each of their corner seal pieces 56 whether a corner seal piece is provided at only one end or at both ends of each main seal piece. Also, although the invention has been described in connection with the specific multi-piece apex seal configuration of U.S. Pat. No. 3,400,697, it obviously is similarly applicable to other multi-piece apex seal configurations, for example, that disclosed in U.S. Pat. No. 3,712,767.

It should be understood that this invention is not limited to the specific details of construction and arrangement thereof herein illustrated and that changes and modifications may occur to one skilled in the art without departing from the spirit or scope of the invention.

what is claimed is:

1. A multi-piece apex seal construction for a rotary mechanism having an outer body with a cavity bounded by a peripheral wall and a pair of axially-spaced end walls and having an inner body mounted within said cavity for rotation relative to said outer body with the inner body having a plurality of apex portions for sealing cooperation with said cavity walls, said multi-piece seal construction comprising:

a. a first seal piece disposed in a groove extending axially across each apex portion of the inner body with at least one end of said first seal piece having an end face inclined to the inner and outer edges of the first seal piece such that the inner edge of said first seal piece is shorter than the outer edge;

b. a second seal piece disposed in said groove adjacent to said inclined end face of the first seal piece and having an end face for sealing engagement with the adjacent end wall of the outer body, said second seal piece also having an inclined face disposed in engagement with said inclined face of the first seal piece;

c. spring means for urging said second seal piece radially outwardly to urge its inclined face into engagement with the adjacent inclined face on the first seal piece; and d. at least one of said inclined faces being arcuate to permit rocking movement of the second seal piece relative to the first seal piece such that the end face of the second seal piece can be flat against the adjacent end wall of the outer body.

2. A multi-piece apex seal as claimed in claim 1 and in which said arcuate face is convex.

3. A multi-piece apex seal as claimed in claim 2 and in which the other of said inclined faces is flat.

4. A multi-piece apex seal as claimed in claim 1 and in which the outer edge of said first seal piece extends substantially from one end wall of the outer body to the other.

5. A multi-piece apex seal as claimed in claim 4 and in which said second seal piece has a generally triangular configuration.

6. A multi-piece apex seal as claimed in claim 5 and in which said arcuate face is convex and the other of said inclined faces is flat.

* * * * *